US007136602B2

(12) United States Patent
Umezawa

(10) Patent No.: US 7,136,602 B2
(45) Date of Patent: Nov. 14, 2006

(54) IMAGE FORMING APPARATUS AND METHOD FOR CONTROLLING FIXING TEMPERATURE OF THE SAME

(75) Inventor: Noriyuki Umezawa, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 162 days.

(21) Appl. No.: 10/890,253

(22) Filed: Jul. 14, 2004

(65) Prior Publication Data

US 2005/0013623 A1 Jan. 20, 2005

(30) Foreign Application Priority Data

Jul. 16, 2003 (JP) ..... 2003-197805

(51) Int. Cl.
*G03G 15/20* (2006.01)

(52) U.S. Cl. ..... 399/70; 399/328

(58) Field of Classification Search ..... 399/38, 399/67, 69, 320, 328, 68, 73; 219/216
See application file for complete search history.

(56) References Cited

U.S. PATENT DOCUMENTS 5,502,546 A * 3/1996 Muto ..... 399/44
6,166,355 A * 12/2000 Watanabe et al. ..... 219/497

FOREIGN PATENT DOCUMENTS

| | | |
|---|---|---|
| JP | 3-279966 A | 12/1991 |
| JP | 6-324531 A | 11/1994 |
| JP | 11-327356 A | 11/1999 |

* cited by examiner

*Primary Examiner*—Hoan Tran
(74) *Attorney, Agent, or Firm*—Foley & Lardner LLP

(57) ABSTRACT

If, in a standby state, no operation is executed for a control panel (11) or ADF (13) before the elapse of a predetermined time measured by a timer (12), the set temperature of a fixer (20) is reduced. After that, if an operation of for the control panel (11) or ADF (13) is executed, the set temperature of the fixer (20) is raised. The set temperature at this time is higher than the fixing temperature in the normal standby state. When the set temperature of the fixer (20) is set to be higher than that in the normal standby state to temporarily increase the heat amount of the fixer (20), the heat amount is hardly absorbed by transfer paper sheets at the time of copy. In addition, since the fixing power increases, the time until a fixing set temperature is obtained can be shortened. Accordingly, power consumption can be reduced without any decrease in operability, productivity, and copy quality.

18 Claims, 5 Drawing Sheets

IMAGE FORMING APPARATUS AND METHOD FOR CONTROLLING FIXING TEMPERATURE OF THE SAME

BACKGROUND OF THE INVENTION

The present invention relates to an image forming apparatus and a fixing temperature control method therefor.

In an image forming apparatus, to start a print operation without taking a long resumption time at the time of copy, control is performed to make a fixer hold a predetermined fixing temperature (e.g., 200° C.) in a normal standby state.

In a conventional image forming apparatus disclosed in patent reference 1 (to be described later), in the standby state, when the approach of an operator to the apparatus is detected in accordance with, e.g., the open/close operation of the document feed table, the temperature of the fixer is raised from the temperature in the standby state to a temperature necessary for fixing processing.

In an image forming apparatus disclosed in patent reference 2 (to be described later), when an original is placed on the original table, and the operation of the operation unit is started, the temperature of the fixer is raised from the temperature in a sleep state or preheat state to a temperature necessary for fixing.

In an image forming apparatus described in patent reference 3 (to be described later), when an enormous number of copies are to be made by using paper sheets with a large size such as A3, the standby temperature of the fixer is raised before the start of copy. After the temperature has risen, copy is started.

In these conventional image forming apparatuses, the fixer in the standby state must be held at a predetermined temperature.

However, if control is executed to always maintain the fixer temperature at, e.g., 200° C., in the standby state, power is wasted while the apparatus is not used.

To prevent such wasteful power consumption, when the user does not use the apparatus for a predetermined time, a power saving operation starts to decrease the fixer temperature to about 100° C.

However, control is performed such that the normal fixer temperature (e.g., 200° C.) is maintained for a predetermined period, i.e., during the period until the apparatus shifts from the standby state to the power saving operation. Hence, power consumption during this time cannot be reduced.

If the fixer temperature during this time is reduced, and the user wants to start copying, the time (first copy time) necessary for the first copy may be long.

Alternatively, assume that a continuous copy operation is to be executed, and particularly, the heat capacity of the fixer is low. Since the fixer is left to stand for a long time in a low temperature state, paper sheets absorb heat in printing, and the heat amount of the fixer decreases. Accordingly, the fixer temperature decreases. As a result, the standby operation may start again during the copy operation to interrupt it or cause fixing errors.

References that disclose the conventional image forming apparatuses are as follows.

Patent reference 1: Japanese Patent Laid-Open No. 06-324531

Patent reference 2: Japanese Patent Laid-Open No. 03-279966

Patent reference 3: Japanese Patent Laid-Open No. 11-327356

As described above, in the conventional image forming apparatuses, if power consumption in the standby state is to be reduced, long time is required until the temperature rises to the fixing temperature necessary for the actual start of printing. This may result in a decrease in operability, productivity, and copy quality.

The present invention has been made in consideration of the above situation, and has as its object to provide an image forming apparatus capable of reducing power consumption without any decrease in operability, productivity, and copy quality, and a fixing temperature control method therefor.

SUMMARY OF THE INVENTION

According to the present invention, there is provided an image forming apparatus comprising:

a fixer which executes fixing processing;

a control panel to set an image forming operation;

a timer which measures time; and a control unit which, if in a standby state in which said fixer is set to a first fixing temperature, no operation is executed for said control panel before the time measured by said timer reaches a predetermined time, sets a second fixing temperature lower than the first fixing temperature, and if an operation is executed for said control panel since then, sets a third fixing temperature higher than the first fixing temperature.

According to the present invention, there is provided a method of controlling a fixing temperature in an image forming apparatus having a fixer which executes fixing processing, and a control panel to set an image forming operation, comprising:

if in a standby state in which the fixer is set to a first fixing temperature, no operation is executed for the control panel before an elapse of a predetermined time, setting a second fixing temperature lower than the first fixing temperature; and if an operation is executed for the control panel since then, setting the fixer to a third fixing temperature higher than the first fixing temperature.

DETAILED DESCRIPTION OF THE INVENTION

The embodiments of the present invention will be described below with reference to the accompanying drawings.

(1) First Embodiment

An image forming apparatus according to the first embodiment of the present invention and a fixing temperature control method therefor will be described.

Figure 1:
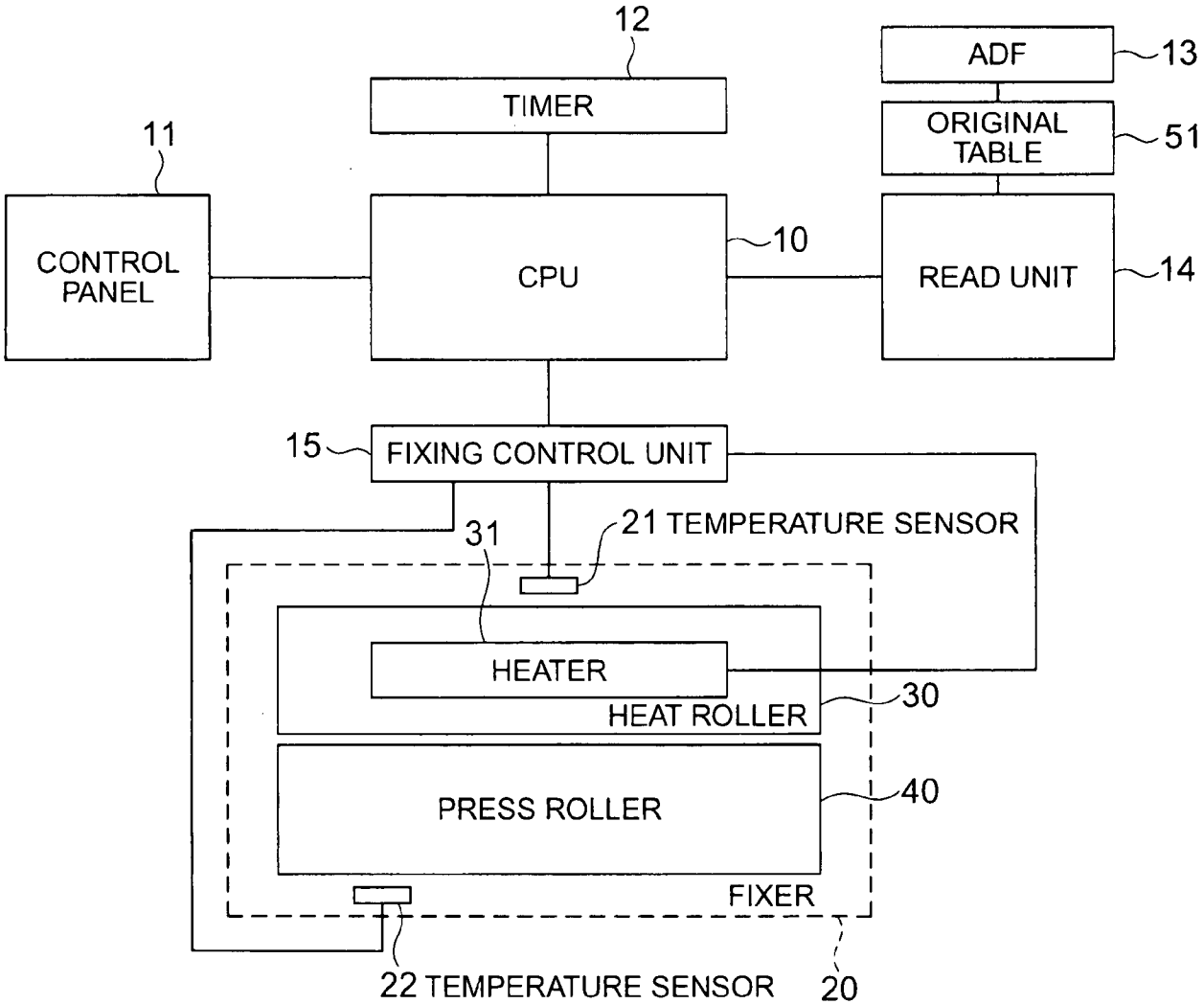
FIG. 1 is a block diagram showing the arrangement of an image forming apparatus according to the first or second embodiment of the present invention.

FIG. 1 shows the arrangement of the image forming apparatus according to the first embodiment.

This apparatus comprises a CPU (Central Processing Unit) 10, control panel 11, timer 12, automatic paper feed/discharge mechanism (to be referred to as an ADF hereinafter) 13, read unit 14, fixing control unit 15, and fixer 20. The fixer 20 has temperature sensors 21 and 22, a heat roller 30 incorporating a heater 31, and a press roller 40.

The CPU 10 controls the operation of the entire image forming apparatus and is connected to the control panel 11, timer 12, read unit 14, and fixing control unit 15. The CPU 10 and fixing control unit 15 constitute a control unit which controls all operations.

The control panel 11 is used by the user to execute operations for the image forming apparatus. On the control panel 11, various settings related to the copy operation or a print key ON operation are or is executed.

The timer 12 measures the time necessary for the control operation in this embodiment.

The ADF 13 automatically feeds or discharges originals. An original table 51 is used to place an original on it.

The read unit 14 reads the image of an original set by the user in the ADF 13 or placed on the original table 51. When the presence of an original is detected, the CPU 10 is notified of it.

The fixing control unit 15 executes control about the fixing temperature of the fixer 20 and setting of a fixing power to be supplied.

In the fixer 20, the temperature sensor 21 is arranged near the heat roller 30 heated by the heater 31 to detect its temperature and notify the fixing control unit 15 of it.

The temperature sensor 22 is arranged near the press roller 40 to detect its temperature and notify the fixing control unit 15 of it.

The operation of the image forming apparatus according to the first embodiment with the above arrangement will be described below.

In this image forming apparatus, in the standby state, if no user operation is executed for the control panel 11, ADF 13, or original table 51 until the elapse of time measured by the timer 12, the set temperature of the fixer 20 is reduced by at least one step. After that, if some operation is executed for at least one of the control panel 11, ADF 13, and original table 51, the set temperature of the fixer 20 is raised.

The set temperature at this time is higher than the fixing temperature in the normal standby state. As described above, the set temperature of the fixer 20 is set to be higher than that in the normal standby state to temporarily increase the heat amount of the fixer 20. Accordingly, the heat amount is hardly absorbed by transfer paper sheets at the time of copy. In addition, since the fixing power increases, the time until a temperature necessary for fixing processing is obtained can be shortened.

Even when the thermal storage effect of the fixer 20 is small, it is hardly affected by the decrease in fixing temperature in the standby state. Hence, the temperature can quickly be returned to the desired fixing temperature before the actual start of copy.

Figure 2:
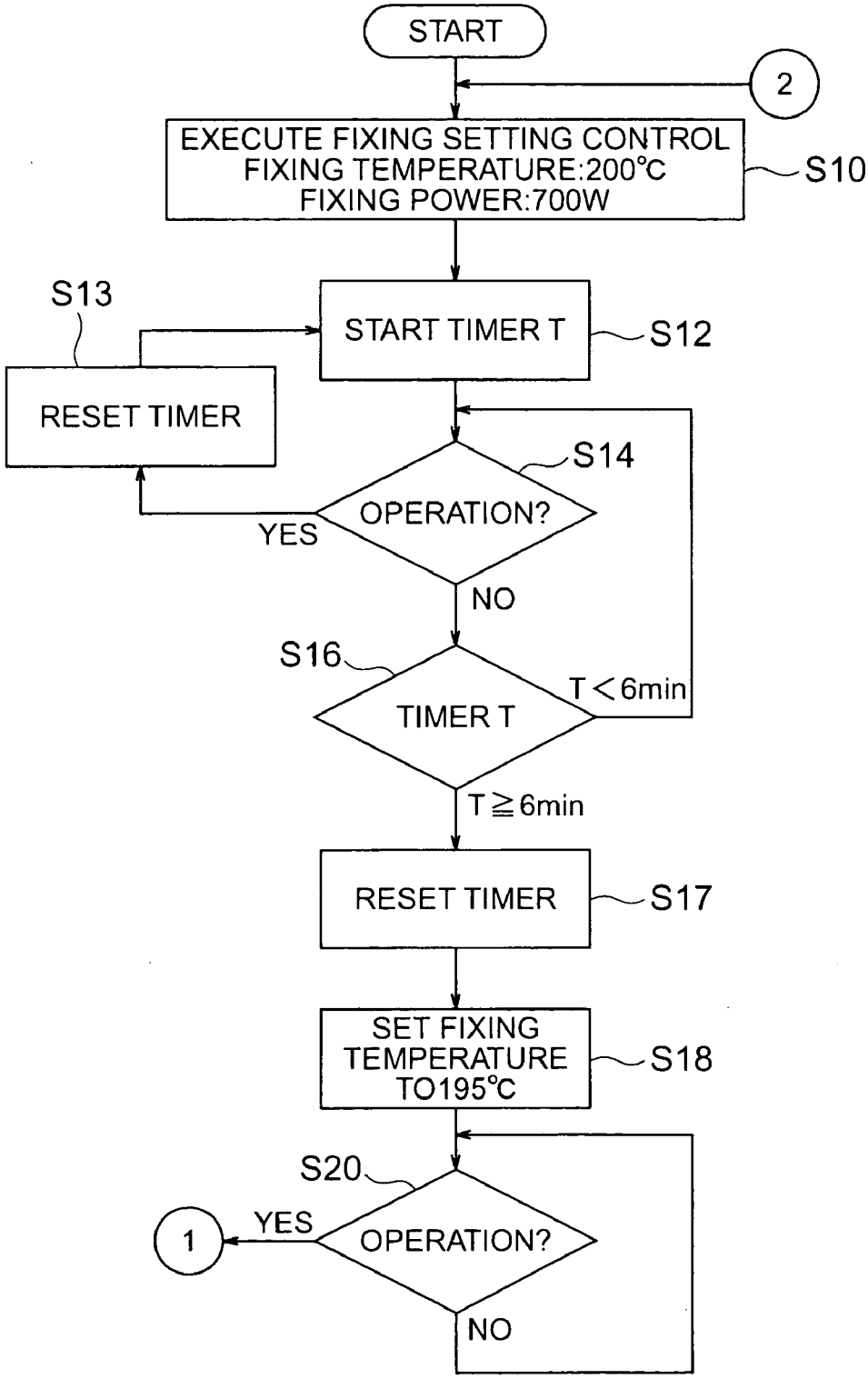
FIG. 2 is a flowchart showing procedures for controlling the fixing temperature in the first embodiment.

FIG. 2 is a flowchart showing fixing temperature control procedures of the image forming apparatus according to this embodiment.

First, in step S10, the fixing control unit 15 sets the fixing temperature of the fixer 20 in the standby state to, e.g., 200° C. and the fixing power to be supplied to the fixer 20 to, e.g., 700 W.

In step S12, the timer 12 measures the time elapsed after the standby state is set.

In step S16, the CPU 10 determines whether a predetermined time T (e.g., 6 min) has elapsed. In step S14, it is determined whether some operation (e.g., an operation for the control panel 11, an operation for the ADF 13, or an operation of setting an original on the original table) related to the copy operation has been executed before the elapse of the predetermined time T.

If no operation has been executed, the CPU 10 resets the measurement by the timer 12 in step S17. In step S18, the fixing control unit 15 reduces the fixing temperature to 195° C.

If some operation related to the copy operation has been executed for the apparatus before the elapse of the predetermined time T, the CPU 10 resets the timer 12 in step S13. The measurement by the timer 12 is restarted from that time in step S12.

In step S20, the CPU 10 determines whether some operation related to the copy operation has been executed after the fixing temperature is reduced to 195° C.

If no operation has been executed, the flow returns to step S20.

Figure 3:
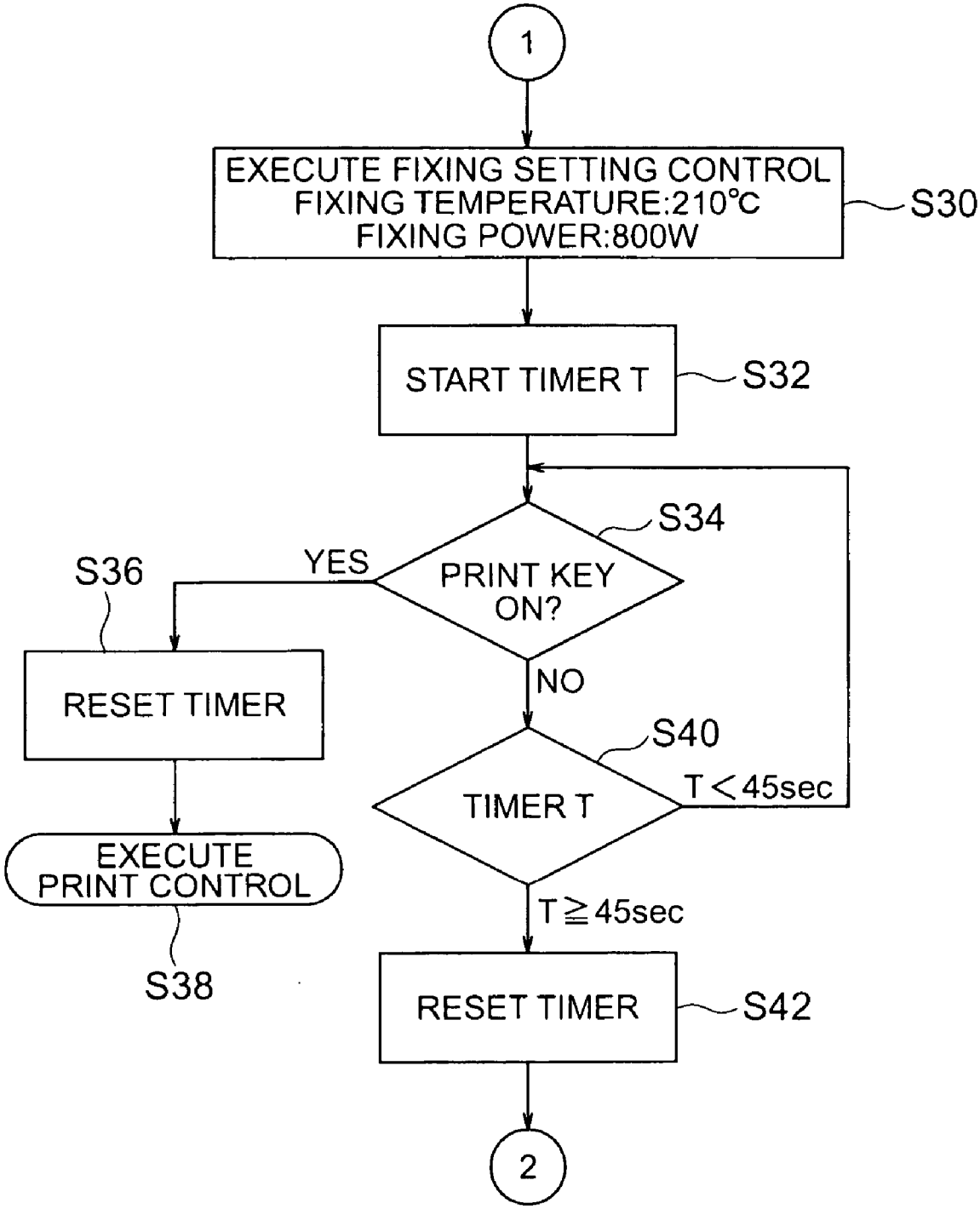
FIG. 3 is a flowchart showing procedures for controlling the fixing temperature in the first embodiment.

If some operation has been executed, the flow advances to step S30 in FIG. 3. The fixing control unit 15 sets the fixing temperature to 210° C. and the set power to 800 W to increase the thermal storage effect of the fixer.

In this embodiment, the fixing temperature is set to 210° C./800 W. However, the present invention is not limited to this temperature. The fixing temperature can be set to an arbitrary value depending on the thermal storage effect of the fixer. In a fixer with a large thermal storage effect, the fixing temperature may be set to a normal value of, e.g., 200° C./700 W.

In step S32, the CPU 10 determines whether an actual copy operation (print key ON) has been executed after the flow advances to step S30.

Assume that no actual copy operation has been executed. More specifically, the timer 12 is operated throughout steps S32, S34, and S40. It is determined whether a copy operation has been executed before the elapse of a predetermined time (e.g., 45 sec) after the operation is executed in step S20.

If a copy operation has been executed before the elapse of 45 sec, the flow advances to step S36 to reset the timer 12. In step S38, print control is executed.

If no copy operation has been executed before the elapse of 45 sec, the timer 12 is reset in step S42. The flow returns to step S10 to return the fixing set temperature and power to settings (200° C. and 700 W) in the normal standby state.

As the predetermined time, an optimum time can arbitrarily be selected in accordance with the thermal storage effect and characteristic of the fixer.

According to this embodiment, power consumption can be reduced without any decrease in operability, productivity, and copy quality.

(2) Second Embodiment

An image forming apparatus according to the second embodiment of the present invention and a fixing temperature control method therefor will be described. In the first embodiment, fixing control is changed in accordance with the elapse of time. As a characteristic feature of the second embodiment, the temperature of the press roller is monitored. When it has reached a predetermined temperature, the set temperature in the standby state is decreased. With this processing, the power in the standby state is reduced while ensuring the thermal storage effect of the fixer.

The arrangement of the image forming apparatus according to the second embodiment is the same as that shown in FIG. 1.

In this embodiment, the fixing temperature and fixing power are controlled on the basis of the temperature of a press roller 40. The control method will be described with reference to the flowcharts shown in FIGS. 4 and 5.

Figure 4:
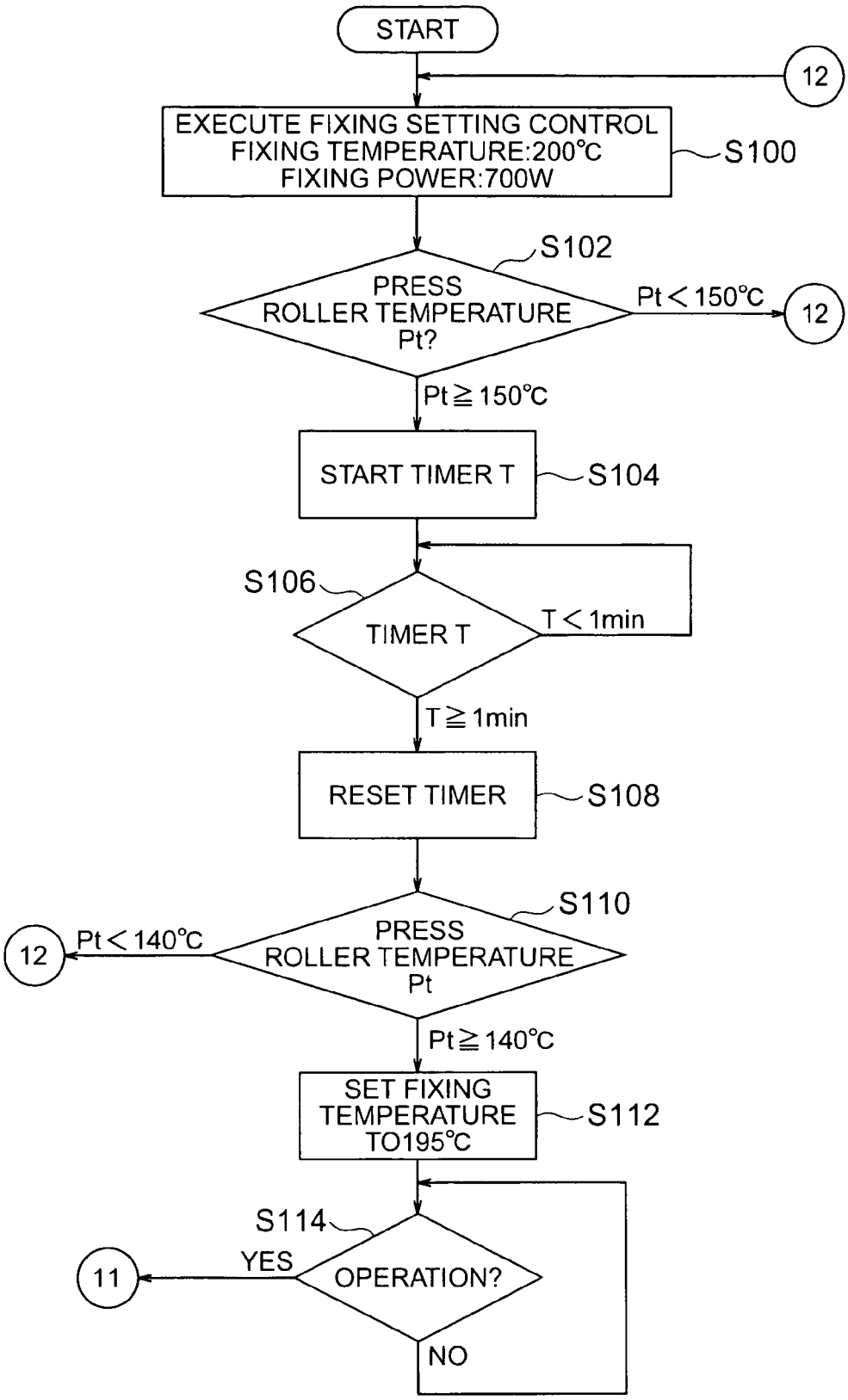
FIG. 4 is a flowchart showing procedures for controlling the fixing temperature in the second embodiment.

First, in step S100 in FIG. 4, a fixing control unit 15 sets the fixing temperature of a fixer 20 in the standby state to, e.g., 200° C. and the fixing power to be supplied to the fixer 20 to, e.g., 700 W.

In step S102, a temperature sensor 22 measures a temperature Pt of the press roller 40 and notifies a CPU 10 of it through the fixing control unit 15.

If the temperature Pt is lower than 150° C., the flow returns to step S100. If the temperature Pt is 150° C. or more, the flow advances to step S104.

In step S104, a timer 12 measures the time elapsed after the standby state is set.

In step S106, the CPU 10 determines whether a predetermined time T (e.g., 1 min) has elapsed. After the time elapses, the flow advances to step S108 to reset the timer 12.

In step S110, the temperature Pt of the press roller 40 is compared with 140° C. If the temperature Pt is lower than 140° C., the flow returns to step S100. If the temperature Pt is 140° C. or more, the flow advances to step S112.

In step S112, the fixing control unit 15 sets the fixing temperature to 195° C.

In step S114, it is determined whether some operation (e.g., an operation for a control panel 11, an operation for an ADF 13, or an operation of setting an original on the original table) related to the copy operation has been executed.

If no operation has been executed, the determination operation in step S114 is repeated.

Figure 5:
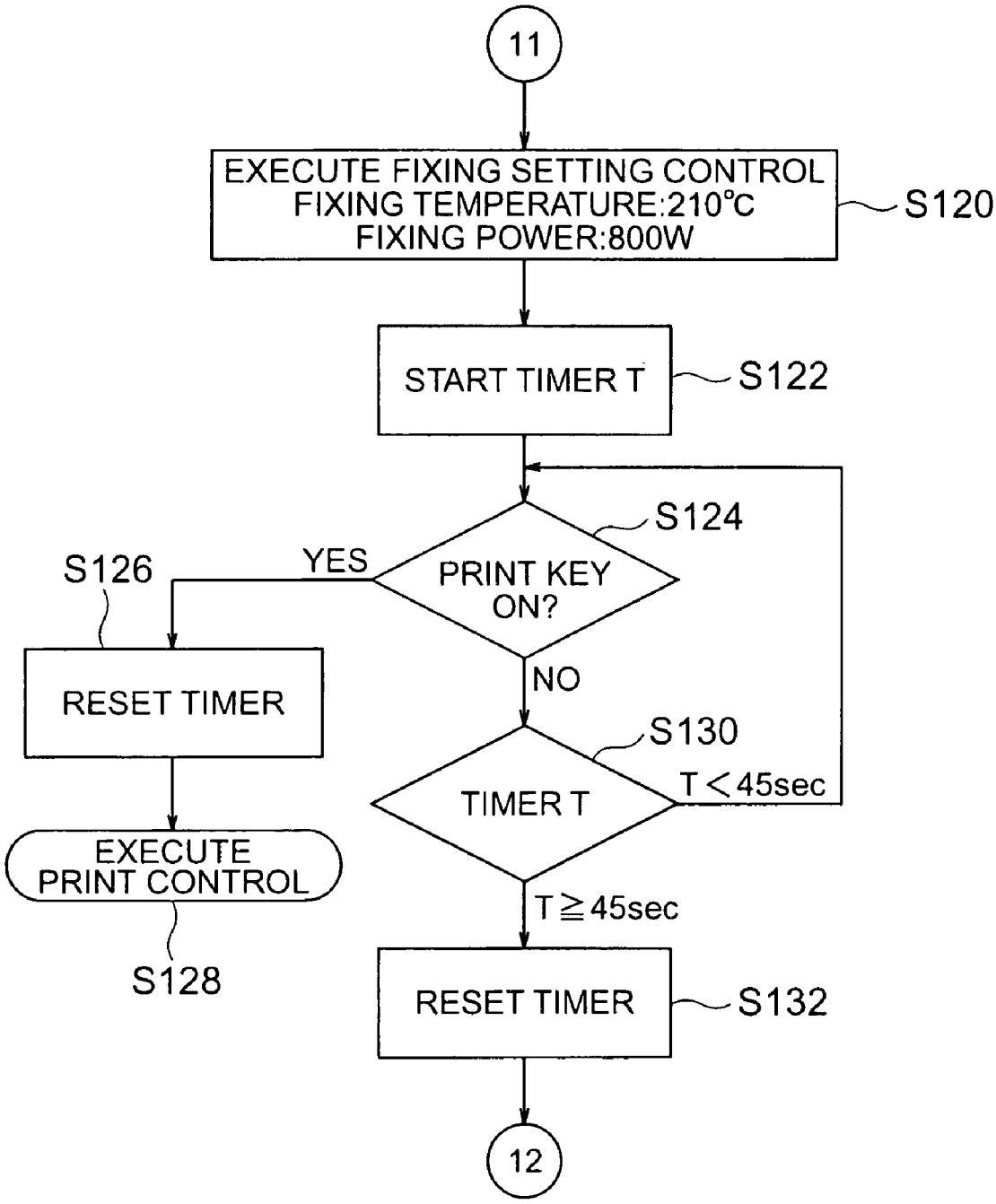
FIG. 5 is a flowchart showing procedures for controlling the fixing temperature in the second embodiment.

If some operation has been executed, the flow advances to step S120 in FIG. 5. The fixing control unit 15 sets the fixing set temperature to 210° C. and the set power to 800 W to increase the thermal storage effect of the fixer.

As in the first embodiment, the fixing temperature is not limited to 210° C./800 W and can be set to an arbitrary value depending on the thermal storage effect of the fixer.

In step S124, the CPU 10 determines whether an actual copy operation has been executed after the flow advances to step S120.

In this case as well, assume that no actual copy operation has been executed, as in the first embodiment. More specifically, the timer 12 is operated throughout steps S122, S124, and S130. It is determined whether a copy operation has been executed before the elapse of a predetermined time (e.g., 45 sec) after the operation is executed in step S130.

If a copy operation has been executed before the elapse of 45 sec, the flow advances to step S126 to reset the timer 12. In step S128, print control is executed.

If no copy operation has been executed before the elapse of 45 sec, the timer 12 is reset in step S132. The flow returns to step S100 to return the fixing set temperature and power to settings (200° C. and 700 W) in the normal standby state.

As the predetermined time, an optimum time can arbitrarily be selected in accordance with the thermal storage effect and characteristic of the fixer.

Even in this embodiment, power consumption can be reduced without any decrease in operability, productivity, and copy quality, as in the first embodiment.

The above-described embodiments are merely examples and do not limit the present invention. For example, in the first embodiment, when no operation is executed from the start of the standby operation to the elapse of the predetermined time, the fixing temperature is reduced to 195° C. in step S18. If an operation is executed in step S20, the fixing temperature is raised to 210° C. in step S30. However, the number of steps is not limited to two and can be set to an arbitrary value as needed.

As described above, according to the embodiments, the time is measured. If no operation is executed before the elapse of a predetermined time, the fixing temperature is reduced. Alternatively, the temperature of the press roller is monitored. When the temperature has reached a predetermined temperature, the set temperature in the standby state is reduced. With this arrangement, power consumption in the standby state can be reduced while ensuring the thermal storage effect of the fixer without any decrease in fixing performance, productivity, and user operability.

What is claimed is:

1. An image forming apparatus comprising:

a fixer which executes fixing processing;

a control panel to set an image forming operation;

a timer which measures time;

a control unit which, if in a standby state in which said fixer is set to a first fixing temperature, no operation is executed for said control panel before the time measured by said timer reaches a predetermined time, sets a second fixing temperature lower than the first fixing temperature, and if an operation is executed for said control panel since then, sets a third fixing temperature higher than the first fixing temperature;

an automatic paper feed/discharge mechanism which feeds and discharges an original; and an original table to place an original, wherein if in the standby state in which said fixer is set to the first fixing temperature, none of an operation for said control panel, an operation for said automatic paper feed/discharge mechanism, and an operation of placing an original on said original table is executed before the time measured by said timer reaches the predetermined time, said control unit sets the second fixing temperature lower than the first fixing temperature, and if one of the operation for said control panel, the operation for said automatic paper feed/discharge mechanism, and the operation of placing an original on said original table is executed since then, said control unit sets the third fixing temperature higher than the first fixing temperature.

2. The apparatus according to claim 1, wherein in the standby state, said control unit sets a supply power to said fixer to a first fixing power, and when setting said fixer to the third fixing temperature, said control unit sets a third fixing power higher than the first fixing power.

3. The apparatus according to claim 1, wherein if no operation of turning on a print key is executed on said control panel before the time measured by said timer reaches a second predetermined time after the fixer is set to the third fixing temperature, said control unit returns said fixer to the standby state in which the first fixing temperature and a first fixing power are set.

4. The apparatus according to claim 1, wherein in the standby state, said control unit sets a supply power to said fixer to a first fixing power, and when setting said fixer to the third fixing temperature, said control unit sets a third fixing power higher than the first fixing power.

5. The apparatus according to claim 1, wherein if no operation of turning on a print key is executed on said control panel before the time measured by said timer reaches a second predetermined time after the fixer is set to the third fixing temperature, said control unit returns said fixer to the standby state in which the first fixing temperature and a first fixing power are set.

6. An image forming apparatus comprising:

a fixer which has a press roller and executes fixing processing;

a control panel to set an image forming operation;

a timer which measures time; and a control unit which, if the press roller has not less than a first predetermined temperature in a standby state in which said fixer is set to a first fixing temperature, and the press roller has not less than a second predetermined temperature lower than the first predetermined temperature after an elapse of a first predetermined time, sets said fixer to a second fixing temperature lower than the first fixing temperature.

7. The apparatus according to claim 6, wherein if an operation is executed for said control panel, said control unit sets said fixer to a third fixing temperature higher than the first fixing temperature.

8. The apparatus according to claim 7, wherein in the standby state, said control unit sets a supply power to said fixer to a first fixing power, and when setting said fixer to the third fixing temperature, said control unit sets a third fixing power higher than the first fixing power.

9. The apparatus according to claim 7, wherein if no operation of turning on a print key is executed on said control panel before the time measured by said timer reaches a second predetermined time after the fixer is set to the third fixing temperature, said control unit returns said fixer to the standby state in which the first fixing temperature and a first fixing power are set.

10. A method of controlling a fixing temperature in an image forming apparatus having a fixer which executes fixing processing, a control unit which controls an operation of said image forming apparatus, and a control panel to set an image forming operation, comprising:

if in a standby state in which the fixer is set to a first fixing temperature, no operation is executed for the control panel before an elapse of a predetermined time, setting a second fixing temperature lower than the first fixing temperature; and if an operation is executed for the control panel since then, setting the fixer to a third fixing temperature higher than the first fixing temperature, wherein the image forming apparatus further comprises an automatic paper feed/discharge mechanism which feeds and discharges an original, and an original table to place an original, and the method further comprises, if in the standby state in which the fixer is set to the first fixing temperature, none of an operation for the control panel, an operation for the automatic paper feed/discharge mechanism, and an operation of placing an original on the original table is executed before the elapse of the predetermined time, setting the second fixing temperature lower than the first fixing temperature, and if one of the operation for the control panel, the operation for the automatic paper feed/discharge mechanism, and the operation of placing an original on the original table is executed since then, setting the fixer to the third fixing temperature higher than the first fixing temperature.

11. The method according to claim 10, wherein in the standby state, a supply power to the fixer is set to a first fixing power, and in the step of setting the fixer to the third fixing temperature, a third fixing power higher than the first fixing power is set.

12. The method according to claim 10, further comprising, if no operation of pressing a print key is executed before an elapse of a second predetermined time after the step of setting the fixer to the third fixing temperature, returning the fixer to the standby state in which the fixer is set to the first fixing temperature.

13. The apparatus according to claim 10, wherein in the standby state, said control unit sets a supply power to said fixer to a first fixing power, and when setting said fixer to the third fixing temperature, said control unit sets a third fixing power higher than the first fixing power.

14. The apparatus according to claim 10, wherein if no operation of turning on a print key is executed on said control panel before the time reaches a second predetermined time after the fixer is set to the third fixing temperature, said control unit returns said fixer to the standby state in which the first fixing temperature and a first fixing power are set.

15. A method of controlling a fixing temperature in an image forming apparatus having a fixer which has a press roller and executes fixing processing, a control unit which controls an operation of said image forming apparatus, and a control panel to set an image forming operation, comprising:

if the press roller has not less than a first predetermined temperature in a standby state in which the fixer is set to a first fixing temperature, and the press roller has not less than a second predetermined temperature lower than the first predetermined temperature after an elapse of a first predetermined time, setting the fixer to a second fixing temperature lower than the first fixing temperature.

16. The method according to claim 15, further comprising the step of, if an operation is executed for the control panel then, setting the fixer to a third fixing temperature higher than the first fixing temperature.

17. The apparatus according to claim 16, wherein in the standby state, said control unit sets a supply power to said fixer to a first fixing power, and when setting said fixer to the third fixing temperature, said control unit sets a third fixing power higher than the first fixing power.

18. The apparatus according to claim 16, wherein if no operation of turning on a print key is executed on said control panel before the time reaches a second predetermined time after the fixer is set to the third fixing temperature, said control unit returns said fixer to the standby state in which the first fixing temperature and a first fixing power are set.

* * * * *